US009930931B2

(12) United States Patent
Leary

(10) Patent No.: US 9,930,931 B2
(45) Date of Patent: Apr. 3, 2018

(54) LACING SYSTEM AND METHOD FOR SECURING THE ENDS OF CORDS AND LACES

(71) Applicant: Sean P. Leary, Henrico, VA (US)

(72) Inventor: Sean P. Leary, Henrico, VA (US)

( * ) Notice: Subject to any disclaimer, the term of this patent is extended or adjusted under 35 U.S.C. 154(b) by 123 days.

(21) Appl. No.: 15/151,488

(22) Filed: May 10, 2016

(65) Prior Publication Data

US 2017/0150784 A1 Jun. 1, 2017

Related U.S. Application Data

(60) Provisional application No. 62/179,570, filed on May 11, 2015.

(51) Int. Cl.

| | |
|---|---|
| ***A43C 7/00*** | (2006.01) |
| ***A43C 1/06*** | (2006.01) |
| ***A43C 7/08*** | (2006.01) |
| ***A43C 7/02*** | (2006.01) |

(52) U.S. Cl.

CPC ..... *A43C 1/06* (2013.01); *A43C 7/005* (2013.01); *A43C 7/02* (2013.01); *A43C 7/08* (2013.01)

(58) Field of Classification Search

CPC .... A43C 1/00; A43C 1/06; A43C 7/00; A43C 7/005

USPC ..... 36/50.1, 50.5

See application file for complete search history.

(56) References Cited

U.S. PATENT DOCUMENTS

| | | | | |
|---|---|---|---|---|
| 2,009,330 | A * | 7/1935 | Tate | A43C 7/00 24/713.1 |
| 3,103,725 | A * | 9/1963 | Robb | A43C 7/00 24/136 R |
| 5,293,675 | A * | 3/1994 | Shai | A43C 7/00 24/712.1 |
| 5,388,315 | A * | 2/1995 | Jones | A43B 3/0078 24/712.1 |
| 5,924,177 | A * | 7/1999 | Jongejan | A43C 7/00 24/712.2 |
| 6,178,606 | B1 * | 1/2001 | Glendon | A43C 7/00 24/115 G |
| 7,082,652 | B2 * | 8/2006 | St-Louis | A43C 7/00 24/715.4 |
| 7,343,652 | B1 * | 3/2008 | Liu | A43C 7/00 24/712.2 |
| 7,347,012 | B2 * | 3/2008 | Clark | A43B 1/14 36/50.1 |
| 8,782,926 | B2 * | 7/2014 | Kishino | A43C 7/00 36/50.1 |
| 8,806,778 | B2 * | 8/2014 | Kishino | A43C 7/00 36/50.1 |
| 8,991,018 | B2 * | 3/2015 | Guthner | A43C 7/00 24/712.1 |
| 2008/0066273 | A1 * | 3/2008 | Liu | A43C 7/00 24/712.5 |
| 2010/0192411 | A1 * | 8/2010 | Leick | A43C 7/00 36/50.1 |
| 2011/0030244 | A1 * | 2/2011 | Motawi | A43B 3/0031 36/117.1 |

(Continued)

*Primary Examiner* — Marie Bays
(74) *Attorney, Agent, or Firm* — IPCL Group PLC

(57) ABSTRACT

A system and method for connecting two loose shoelace ends, or for connecting two loose lace or cord ends in any lacing situation. A specific lace or cord orientation is used along with a heat-shrinkable tubular connector in order to easily and securely connect the two ends of the laces or other such cords.

10 Claims, 2 Drawing Sheets

(56) References Cited

U.S. PATENT DOCUMENTS

| | | | | |
|---|---|---|---|---|
| 2014/0137432 | A1* | 5/2014 | Eldem | A43B 1/0081 36/50.1 |
| 2014/0366340 | A1* | 12/2014 | Park | A43C 3/00 24/712.2 |
| 2015/0342261 | A1* | 12/2015 | Boucher | A43B 1/04 36/84 |

* cited by examiner

LACING SYSTEM AND METHOD FOR SECURING THE ENDS OF CORDS AND LACES

This application claims priority from U.S. Provisional Patent application No. 62/179,570 filed on May 11, 2015.

FIELD OF THE INVENTION

The present invention relates to a system and method for connecting the ends of cords and laces, more specifically, a system and method for securing laces on shoes and other foot apparel.

BACKGROUND OF THE INVENTION

Shoelaces have been used for centuries to connect the lateral sides of a shoe or other item of footwear. Shoe-wearers generally connect the sides of their shoes by lacing the sides together in a pattern over the top of the foot, and connect the loose ends of the laces by tying them in a knot, allowing the shoe-wearer to tighten the shoe and secure the shoe to the foot.

While lacing is an effective system, it suffers from persistent problems that are a direct result of the need to tie one's shoes. Specifically, (i) the shoe-wearer must tie his or her shoelaces anew each time the shoes are worn, (ii) knots commonly used to connect the ends of shoelaces for efficient tying and untying frequently come undone at undesired times, (iii) in cases of relaxed, hurried, or short-term use for which the shoe-wearer might not want to take the time to tie his or her shoes, the shoe-wearer is left with two loose shoelace ends trailing from each foot, creating a hazard and causing damage to the shoelaces, (iv) once tied, if the shoe-wearer wants to make adjustments, he or she must untie the shoe, make the desired adjustments, and then retie the shoe for each adjustment, (v) athletes and those in need of tactical footwear solutions can be hindered by the time tying one's shoes necessarily requires, and (vi) children, the elderly, invalids, and others may lack the dexterity needed to tie their shoes on their own, greatly reducing their freedom and independence.

Several viable products directed to the foregoing problems have been developed and have found commercial success. Most of these products have not eliminated the shoelace, but have instead attempted to improve upon the original system of tying the lace. Configurations for these systems often consist of shoelaces connecting the two sides of a shoe as in the original configuration, but these systems replace the shoelace knot with some type of adjustable friction lace lock.

Although some of these products are moderately effective, they could certainly be improved upon. While systems using adjustable lace locks have proven popular, there is one primary part of the system needing improvement, namely, what to do with the ends of the laces left dangling after they have run through the lace lock. Manufacturers who design shoes incorporating lace locks may sew the lace ends together or secure the lace ends with a permanent piece of hard plastic during the manufacturing process, before the shoe reaches the customer. Manufacturers who design shoelace systems using lace locks for aftermarket replacement of existing shoelaces by the customer may provide two pieces of hard-plastic that the customer can snap together to clamp the lace ends, creating a housing over the lace ends that often fails to hold the lace ends together, especially when pulled on during shoe tightening. This failure can be a serious problem for athletic or tactical applications requiring speed or for the "outdoors-person" relying on the durability of his or her gear. The aftermarket system manufacturer may also provide a single-piece, hard-plastic housing that still requires the shoe-wearer to tie a knot. The shoe-wearer may find that the system works better with the knot alone, without the extra hard-plastic housing, or that a knot in the end of the laces is aesthetically displeasing. Many shoe-wearers in need of a solution for the need to tie their laces find that the solutions currently available just don't fully satisfy their requirements.

A need therefore exists for an improved system and method for connecting two shoelaces. The present invention solves the aforementioned problems and provides a simple and effective method to accomplish the required end.

SUMMARY OF THE INVENTION

The present invention discloses a system and method for connecting two loose shoelace ends, or for connecting two loose lace or cord ends in any other lacing situation. This invention provides an effective and desirable solution to durably connect two loose lace ends. The system is a reliable cord or lace closure system that can be used with static, dynamic, or elastic cord or lace and can be used to connect two loose lace or cord ends under a variety of circumstances.

The system and method may be applied to loose shoelace ends after a shoe, or other item of footwear, has been laced and the lace ends have passed through an adjustable lace lock. The shoelace ends are then secured to form a closed lace loop above the shoe, of a diameter set by the user, by a process of hooking the lace ends together and the application of a heat-shrinkable connector element over this new lace junction. The result is a durable and reliable closed shoelace system that can be repeatedly adjusted, allowing the user to secure and adjust the shoe on the foot by pulling on the tube-covered junction of the laces with one hand while sliding the lace lock into position along the shoelace loop with the other hand.

DETAILED DESCRIPTION

The preferred embodiment of the present invention involves a particular lacing configuration, maintained through the use of a heat-shrinkable connector element, in order to secure shoe laces or other such cords. The instant system and method may be applied to loose shoelace ends after a shoe, or other item of footwear, has been laced and the lace ends have passed through an adjustable lace lock. The shoelace ends are then secured to form a closed lace loop above the shoe, of a diameter set by the user, by a process of hooking the lace ends together and the placement of a heat-shrinkable connector over the junction of the laces. In the preferred embodiment, the heat-shrinkable connector used to form the closed loop consists of a section of heat-shrinkable tubing, i.e., adhesive lined polyolefin tubing. It will be recognized that varying sizes of heat-shrinkable tubing may be used to accommodate other materials or sizes of laces.

Figure 1:
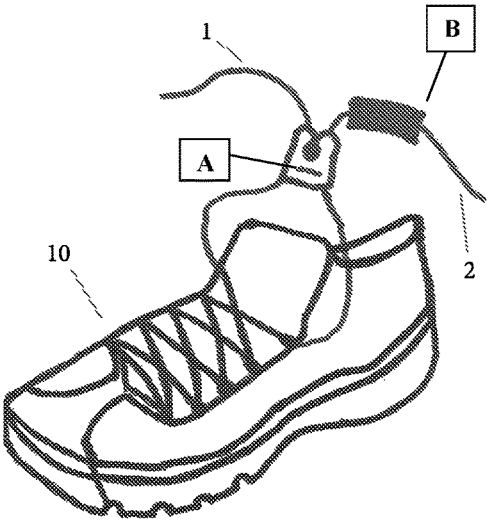
FIG. 1 is a perspective view of step 1 of the method disclosed herein.

The configuration and process for assembling the system described above is accomplished in these steps: In the first step shown in FIG. 1, after a shoe (10) has been laced and the lace ends have passed through a lace lock (A), two loose lace ends, a first end (1) and a second end (2), are left. One of the lace ends is then threaded through a section of heat-shrinkable tubing (B), and the tubing is slid down the lace to the lace lock (or what may otherwise constitute the base of the lace in any other lacing situation).

Figure 2:
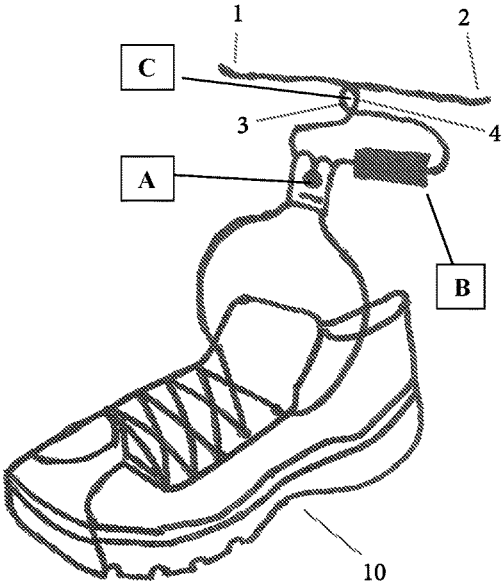
FIG. 2 is a perspective view of step 2 of the method disclosed herein.

In the second step, as seen in FIG. 2, the loose lace ends (1, 2) are hooked together: A first bight (3), a U-shaped curve in a rope, is made from one of the lace ends. The other lace end is threaded through that first bight (3) and then itself curved over into a second bight (4). The result of the second step is the two lace ends hooked together by the junction of the bights (C). The two lace ends together now form a closed loop above the shoe with the junction of the bights (C) at the apex. Both sides of the closed loop run through the lace lock (A), and the heat-shrinkable tubing (B) is on one side of the loop above the lace lock (A).

Figure 3:
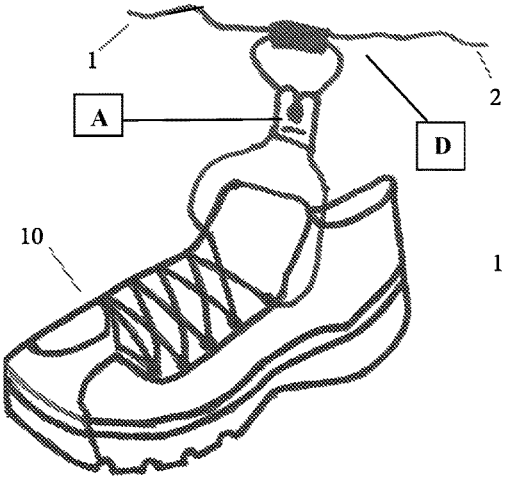
FIG. 3 is a perspective view of step 3 of the method disclosed herein.

Referring to FIG. 3, the heat-shrinkable tubing is raised in the third step by it sliding along its lace to cover the junction of the bights (C). As the heat-shrinkable tubing (B) is slid up along its lace toward the junction of the bights, the tip of its lace is threaded back through the tubing (B) in the opposite direction, so that the tubing will come to slide entirely over the junction of the bights as shown in FIG. 3. The heat-shrinkable tubing is centered over, and completely covers, the junction of the bights (C). The new configuration of the junction is now designated as (D). The two loose lace ends (1, 2) protrude and extend from the junction (D).

Figure 4:
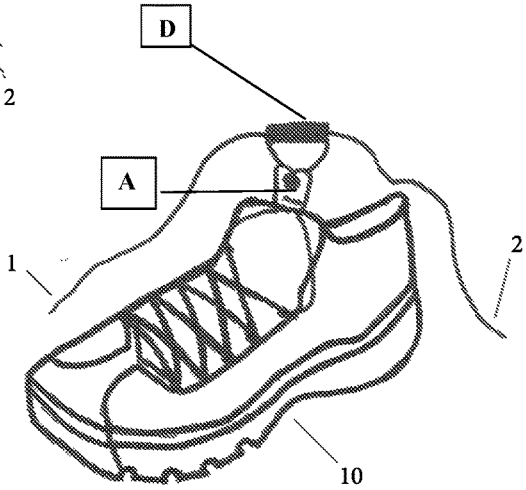
FIG. 4 is a perspective view of step 4 of the method disclosed herein.

In the fourth step, shown in FIG. 4, the entire closed lace loop above the shoe, comprised of the two laces joined at the junction (D), is adjusted to the desired diameter by moving the junction at the apex (D) toward the shoe. The desired diameter of the closed lace loop is just large enough to allow the user to comfortably loosen the shoe to place it on and off the foot, with no excess lace left in the closed lace loop and the junction (D) lowered to be just above the lace lock (A). In this step illustrated in FIG. 4, the lace lock (A) is first set to the place on the loop that creates the desired diameter. To make the adjustment, the two loose lace ends (1, 2), protruding from the junction (D), are then pulled simultaneously and equally, sliding the laces through the junction (D). The lace ends (1, 2) are pulled until the closed lace loop decreases to the desired diameter, with the junction (D) just above the set lace lock (A). Once the junction (D) is in the desired position, the junction (D) is dressed so that the lace bights inside meet tautly in the middle of the junction (D).

Figure 5:
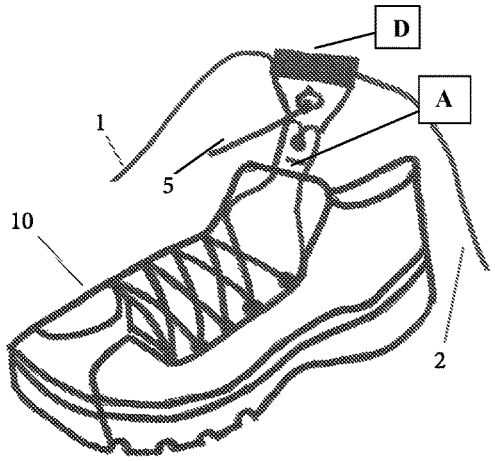
FIG. 5 is a perspective view of step 5 of the method disclosed herein.

In the fifth step, the heat-shrinkable tubing is subjected to heat in order to set it and secure the junction (D) into a fixed position. A match, a lighter, heat gun, or a similar source of heat is used to heat the junction and set the heat-shrinkable tubing. In FIG. 5, a match (5) is used to set the connector element. When the heat-shrinkable tubing is heated, it decreases in size to squeeze the laces together against themselves, helping to provide the friction needed to keep the laces from slipping.

Figure 6:
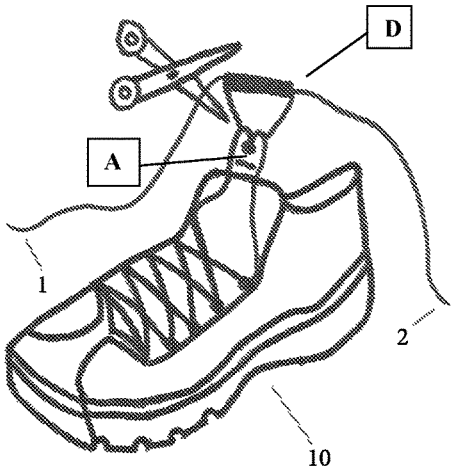
FIG. 6 is a perspective view of step 6 of the method disclosed herein.

In the sixth step, illustrated in FIG. 6, the protruding ends of the laces (1, 2) are trimmed off cleanly where they meet the ends of junction (D). In the preferred embodiment, a pair of scissors or shears is used to trim the lace ends (1, 2).

Figure 7:
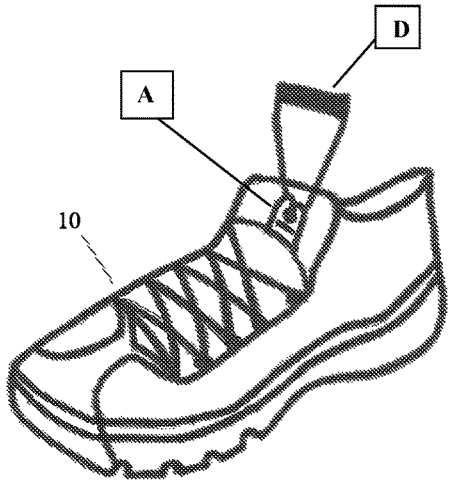
FIG. 7 is a perspective view of step 7 of the method disclosed herein.
Figure 8:
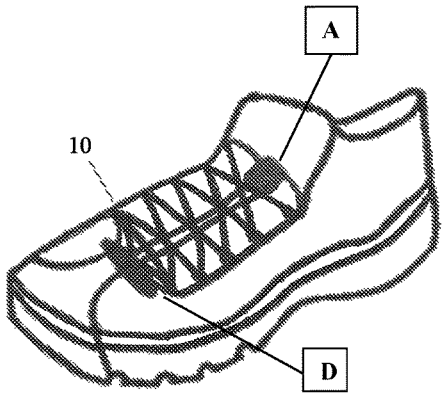
FIG. 8 is a perspective view of step 8 of the method disclosed herein.

At this point, the shoe-wearer can now use the closed lace system to repeatedly adjust the shoe, as seen in FIG. 7. The adjustments are made by holding the junction (D) with one hand while sliding and setting the lace lock (A) along the closed lace loop above the shoe with the other hand. The adjustments can be made to secure the shoe to the foot, to remove the shoe, and to make quick adjustments while wearing the shoe. The remaining lace loop can be secured to the shoe with an added component, such as a clip, loop, or pocket, or the junction (D) can be tucked under one of the lace points on top of the shoe, thereby securing the remaining loop to the shoe as illustrated in FIG. 8.

The system can be used in aftermarket shoelace systems designed to replace existing shoelaces, as well as in the original shoe-manufacturing process, as an add-on during shoe sales, as a standalone product, and/or in any other lacing situation.

This invention is designed to provide an economical solution to the problems resulting from the need to tie one's shoes, and as a solution to the flaws in many of the currently available products related to the problems resulting from the need to tie one's shoes. Similar to the other available products, when using this invention, the user does not need to tie and untie his or her shoes each time they are worn or adjusted. In cases of relaxed, hurried, or short-term use for which the user might not want to take the time to tie his or her shoes, the user is not left with two loose shoelace ends trailing from each foot, creating a hazard and causing damage to the shoelaces. If the user wants to make adjustments, he or she does not need to untie the shoe to make the desired adjustments, and then retie the shoe for each adjustment. Athletes and those in need of tactical footwear solutions are not hindered by the time tying one's shoes necessarily requires. And children, the elderly, invalids, and others who may lack the dexterity needed to tie their shoes on their own can gain some freedom and independence.

In contrast to many of the currently available products related to the problems resulting from the need to tie one's shoes, this invention provides a solution to some persistent problems. This is a durable system that can work with different types of laces. Shoe-wearers who need to rely on their gear in emergency situations, in situations requiring fast lacing, and in situations requiring long-term exposure to extreme environments can trust that this solution will not fail, and that their laces will not then come undone. And, importantly, many shoe-wearers will find that this invention provides the simple, clean aesthetic they desire, while providing a convenient finger-pull. This invention provides a desirable alternative to the other available products relating to the problems resulting from the need to tie one's shoes.

While the invention has been described in reference to certain preferred embodiments, it will be readily apparent to one of ordinary skill in the art that certain modifications or variations may be made to the device without departing from the scope of invention described in the foregoing specification.

What is claimed is:

1. A method for securing and manipulating the laces of a shoe comprising the steps of:

providing a laced shoe having a shoelace passing through a lace lock connector means and having a first end portion and a second end portion; each of said end portions terminating in a tip;

positioning a tubular connector element at the base of said second end portion of said shoelace;

forming a first bight with said first end portion;

passing the second end portion around the first bight formed by said first end portion to form a second bight; the intersection of said first and second bights forming a closed loop;

sliding the tubular connector element along said lace toward said closed loop and concurrently threading the tip of said second end portion back through the tubular connector until the tubular connector is positioned entirely over the closed loop thereby forming a permanent lace loop;

adjusting the permanent lace loop to the desired diameter for comfortable operation; and, locking the tubular connector element into a fixed position.

2. The method of claim 1 further comprising trimming any unwanted sections of the first end portion and second end portion which protrude from the tubular connector element.

3. The method of claim 2 further comprising securing the permanent lace loop to the shoe.

4. The method of claim 3 wherein securing said permanent lace loop comprises using a clip to secure said permanent lace loop.

5. The method of claim 3 wherein securing said permanent lace loop comprises using a pocket to secure said permanent lace loop.

6. The method of claim 3 wherein securing said permanent lace loop comprises tucking said permanent lace loop under a section of the laced portion of the shoe.

7. The method of claim 1 wherein said tubular connector element comprises a section of heat-shrinkable tubing.

8. The method of claim 7 wherein locking said tubular connector element into a fixed position comprises heating the heat-shrinkable tubing in order to set it into a fixed position.

9. A method for securing and manipulating the laces of a shoe comprising:

a shoe;

a shoelace threaded through at least two of the holes in said shoe; and, a lace lock connector means; said shoelace having two ends which pass through said lace lock connector means and terminate in a first end portion and a second end portion;

wherein the method comprises:

positioning a tubular connector element on said second end portion of said shoelace;

forming a first bight with said first end portion;

passing the second end portion around said first end portion to form a second bight; the intersection of said first and second bights forming an intertwined section;

sliding the tubular connector along said lace toward said intertwined section and concurrently threading the tip of said second end portion back through the tubular connector until the tubular connector is positioned entirely over the intertwined section thereby forming a permanent lace loop;

adjusting the permanent lace loop to the desired diameter for operation;

securing the tubular connector element into a fixed position via heat shrinkage; and, trimming any sections of the first end portion and second end portion which protrude from the tubular connector and are not used to form the permanent lace loop.

10. A method for securing and manipulating the laces of a shoe comprising:

a shoe;

a shoelace threaded through at least two of the holes in said shoe; and, a lace lock connector means; said shoelace having two ends which pass through said lace lock connector means and terminate in a first end portion and a second end portion;

wherein the method comprises:

positioning a tubular connector element on either said first end portion or said second end portion of said shoelace; the portion having said connector being a connector side and the portion not bearing said connector being a loose side;

forming a first bight with said loose side;

crossing the connector side through and around said loose side to form a second bight;

the intersection of said first and second bights forming an intertwined section;

sliding the tubular connector along said lace toward said intertwined section and concurrently threading the tip of said connector side back through the tubular connector until the tubular connector is positioned entirely over the intertwined section thereby forming a permanent lace loop;

adjusting the permanent lace loop to the desired diameter for operation;

securing the tubular connector element into a fixed position via heat shrinkage; and, trimming any sections of the first end portion and second end portion which protrude from the tubular connector and are not used to form the permanent lace loop.

* * * * *